US005895038A

United States Patent [19]

Takashima

[11] Patent Number: 5,895,038

[45] Date of Patent: Apr. 20, 1999

[54] SHEET SUPPLY APPARATUS

[75] Inventor: Kazunori Takashima, Kamakura, Japan

[73] Assignee: Canon Kabushiki Kaisha, Tokyo, Japan

[21] Appl. No.: 08/602,148

[22] Filed: Feb. 15, 1996

[30] Foreign Application Priority Data

Feb. 15, 1995 [JP] Japan ..... 7-026745

[51] Int. Cl.[6] ..... B65H 3/06

[52] U.S. Cl. ..... 271/114; 271/126; 271/127

[58] Field of Search ..... 271/114, 117, 271/118, 121, 126, 127

[56] References Cited

U.S. PATENT DOCUMENTS 4,717,139 1/1988 Sootoms et al. ..... 271/118
5,213,426 5/1993 Ewing ..... 271/114
5,228,676 7/1993 Arai et al. ..... 271/117
5,358,230 10/1994 Ikemori et al. ..... 271/118
5,419,543 5/1995 Nakamura et al. ..... 271/114

*Primary Examiner*—H. Grant Skaggs
*Attorney, Agent, or Firm*—Fitzpatrick Cella Harper & Scinto

[57] ABSTRACT

The present invention provides a sheet supply apparatus comprises a rocking sheet support plate for stacking sheets, a sheet supply, device capable of contacting with the sheets stacked on the sheet support plate for supplying them, a rotation control for controlling rotation of the sheet supply device by transmitting or not transmitting a driving force from a drive source, a cam for shifting the sheet support plate to abut or separate the sheet supply device and the sheet, and a rotation transmitting device for transmitting rotation to the cam.

19 Claims, 14 Drawing Sheets

SHEET SUPPLY APPARATUS

BACKGROUND OF THE INVENTION

1. Field of the Invention

The present invention relates to a sheet supply apparatus for supplying a sheet such as an original, a recording medium and the like to an image forming apparatus such as a printer, a facsimile, a copying machine and the like.

2. Related Background Art

Among sheet supply apparatuses used with an image forming apparatus, there has been proposed a sheet supply apparatus in which a sheet support plate for supporting a sheet stack can be lifted and lowered so that, when the sheet support plate is lifted, the sheet stack is urged against a sheet supply roller and an uppermost sheet in the sheet stack is supplied by rotation of the sheet supply roller and that, after the sheet is supplied, the sheet support plate is lowered.

An example of such a conventional sheet supply apparatus will now be explained with reference to FIGS. 13 and 14. Incidentally, FIG. 13 is a sectional view of a sheet supply apparatus, and FIG. 14 is a view showing a drive system for lifting and lowering a sheet support plate.

A sheet support plate 100 for stacking sheets is pivotally mounted on a rock shaft 102 for upward and downward rocking movement and is normally biased upwardly by pressure springs 104. Cams 108 are provided on a shaft 106*a* for supporting a sheet supply roller 106 so that, when the sheet supply roller 106 is stopped, the cams 108 are contacted with rollers 110 provided on the sheet support plate 100 to lower and maintain the sheet support plate in a lowered position, i.e. a sheet stacking position where any sheets can be loaded on the sheet support plate.

A notched gear 112 having a non-toothed portion 112*a* is secured to the shaft 106*a* of the sheet supply roller 106, which gear is adapted to engaged by an idler gear 114 connected to a drive source (not shown). Rotation of the notched gear 112 can be regulated by a rock rod 116. When the rotation of the notched gear is regulated, the non-toothed portion 112*a* of the notched gear 112 is opposed to the idler gear 114, with the result that the driving force from the drive source is not transmitted to the notched gear.

Further, there is provided a release mechanism for releasing the regulation of the rod 116. The release mechanism comprises a release cam 118 for rocking the rod 116 to release the regulation of the rod 116 by rotation of the cam, a notched gear 120 disposed in coaxial with the release cam 118 and adapted to be engaged by the idler gear 114, a spring 122 for biasing the notched gear 120 toward its rotational direction, and a solenoid 124 for regulating a position of the release cam 118 in opposition to a biasing force of the spring 122.

On the other hand, a separation means for separating the sheets is disposed at a downstream side of the sheet support plate 100. The separation means comprises a main pad 126 and a sub pad 128. The main pad 126 adapted to be urged against the sheet supply roller 106 in order to separate the sheets one by one when the sheets are fed out by the sheet supply roller 106, and is contacted with and separate from the sheet supply roller 106 in response to the lifting and lowering movements of the sheet support plate 100. The sub pad 128 is advanced or protruded into a sheet path when the main pad 126 is separated from the sheet supply roller 106, with the result that tip ends of second, third and other sheets are stopped by the sub pad, thereby preventing the double-feed of sheets.

With this arrangement, when the regulation of the release cam 118 is released by activating the solenoid 124, the notched gear 120 is rotated by the biasing force of the spring 122 to engage the notched gear by the idler gear 114. As a result, the release cam 118 is rotated. When the rod 116 is rocked by the rotation of the cam 118 to release the regulation of the cams 108, the cams 108 are rotated by the biasing forces of the pressure springs 104 via the rollers 110. Consequently, the sheet support plate 100 is lifted, and, at the same time, the notched gear 112 is engaged by the idler gear 114, with the result that the driving force is transmitted to the shaft 106*a* of the sheect supply roller 106 to rotate the sheet supply roller 106, thereby the uppermost sheet in the sheets stacked on the sheet support plate 100 is fed out. When the sheet supply roller 106 is rotated by one revolution, the sheet support plate 100 is lowered again by the cams 108, and, in the lowered position, the rotation of the cams 108 is regulated by the rod 116.

While the sheets are being separated one by one between the sheet supply roller 106 and the main pad 126 by the rotation of the sheet supply roller, the cams 108 start to lower the sheet support plate 100 again. In this case, although the main pad 126 starts to separate from the sheet supply roller 106, before the separation of the main pad, the sub pad 128 is protruded into the sheet path. The sub pad 128 serves to prevent the second and other sheets from being fed out together with the separated sheet. In this way, back tension acting on the fed sheet can be reduced and the driving force for conveying the sheet can be set smaller, with the result that the apparatus can be made compact and cost-down can be achieved.

However, the above-mentioned conventional sheet supply apparatus has the following drawback.

Namely, in the above-mentioned conventional sheet supply apparatus, since one revolution of the sheet supply roller 106 is controlled by using the notched gear 112 and the sheet support plate 100 is lifted and lowered on the basis of one revolution of the sheet supply roller, a sheet feeding amount of the sheet supply roller 106 is limited. That is to say, since the sheet is fed only during one revolution of the sheet supply roller 106, a sheet feed amount is relatively small, and, thus, a distance between the sheet supply roller and convey rollers disposed at a downstream side of the sheet supply roller must be shortened. As a result, the number of convey rollers must be increased accordingly, which results in the cost-up of the apparatus.

Although the sheet feed amount can be increased by increasing a diameter of the sheet supply roller, the apparatus will become bulky.

SUMMARY OF THE INVENTION

The present invention aims to eliminate the above-mentioned conventional drawback, and an object of the present invention is to control a lift/lower movement of a sheet support plate and rotation of a sheet supply roller independently.

To achieve the above object, according to the present invention, there is provided a sheet supply apparatus comprising a rocking sheet support plate for stacking sheets, a sheet supply means capable of being contacted with the sheets stacked on the sheet support plate and adapted to feed out the sheet or sheets, a rotation control meals for controlling rotation of the sheet supply means, a cam means for shifting the sheet support plate to effect engagement and disengagement between the sheet supply means and the sheet, and a rotation transmitting means for transmitting rotation to the cam means. Wherein the rotation transmitting means includes a rock gear connected to a drive source and capable of being engaged by a gear connected to the cam means so that the transmission of the rotation to the cam means is permitted or prohibited in accordance with a rocking movement of the rock gear.

Further, the present invention provides a sheet supply apparatus comprising a rocking sheet support plate for stacking sheets, a sheet supply means capable of being contacted with the sheets stacked on the sheet support plate and adapted to feed out the sheet or sheets, a rotation control means for controlling rotation of the sheet supply mans, a cam means for shifting the sheet support plate to effect engagement and disengagement between the sheet supply means and the sheet, a rotation transmitting means for transmitting rotation to the cam means, a stopper means for regulating the rotation of the cam means when the rotation is not transmitted to the cam means, a biasing means for biasing the cam means toward a rotational direction when the regulation of the stopper means is released, and a rotation regulating means for temporarily stopping the rotation of the cam means in opposition to a biasing force of the biasing means when the regulation of the stopper means is released.

With the arrangement as mentioned above, the rotation of the sheet supply means for feeding out the sheet can be controlled by the rotation control means, and, since the lift/lower movement of the sheet support plate is effected by the rotation of the cam means in response to the rocking movement of the rock gear, the lift/lower movement of the sheet support plate and the rotation of the sheet supply roller can be controlled independently.

By regulating the rotation of the cam means by the stopper means when the sheet support plate is in a lifted position and by rotating the sheet supply means by the rotation control means, a sheet feed amount can freely be adjusted or set. And, when the stopper means is released, by temporarily regulating the rotation of the cam means by the rotation regulating means, the excessive rotation of the cam means effected by the biasing means can be prevented, thereby avoiding poor operation.

DETAILED DESCRIPTION OF THE PREFERRED EMBODIMENTS

The present invention will now be explained in connection with embodiments thereof with reference to the accompanying drawings. First of all, a sheet supply apparatus A according to a first embodiment of the present invention will be described with reference to FIGS. 1 to 11.

Figure 1:
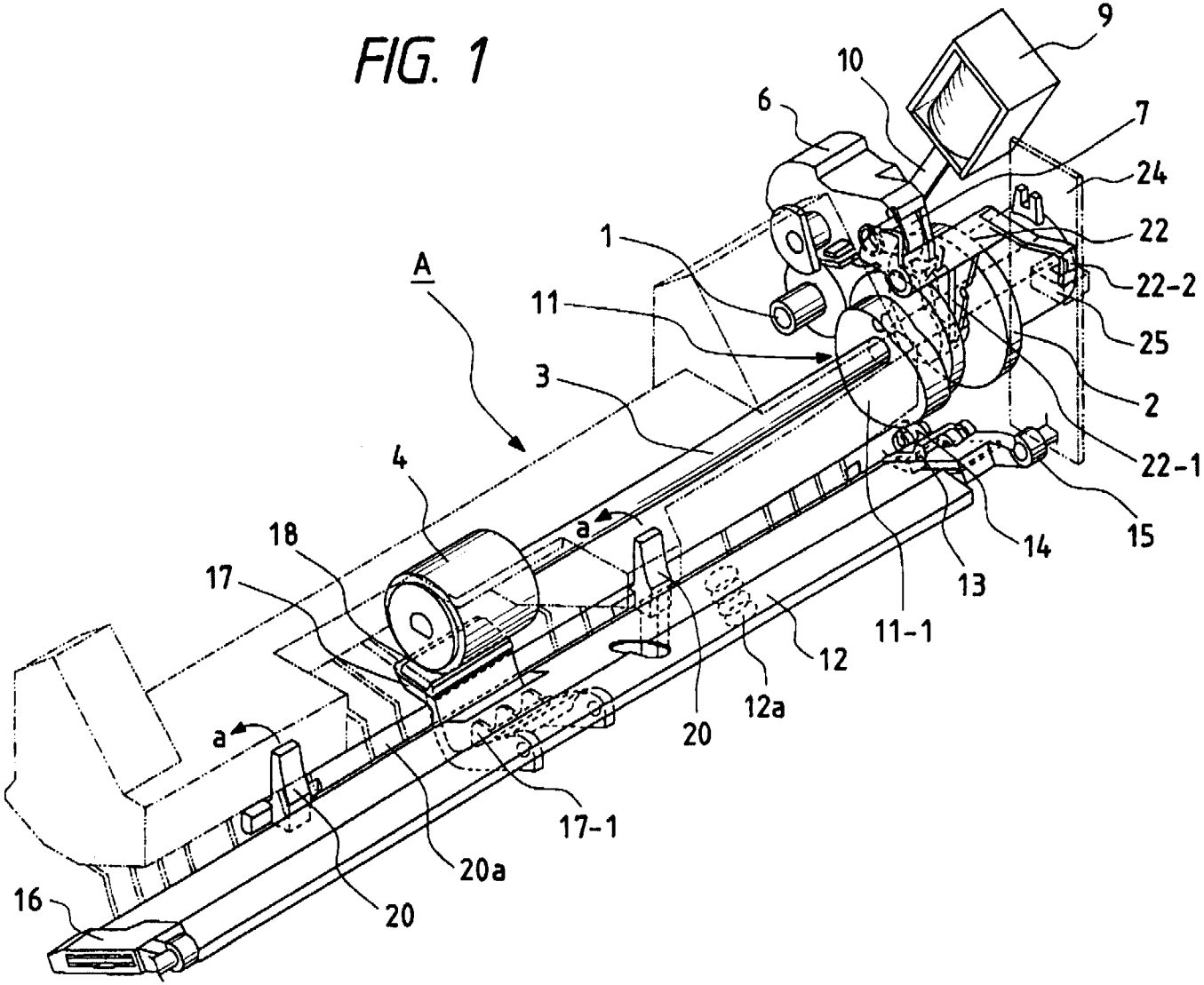
FIG. 1 is a perspective view of a sheet supply apparatus according to a first embodiment of the present invention.
Figure 2:
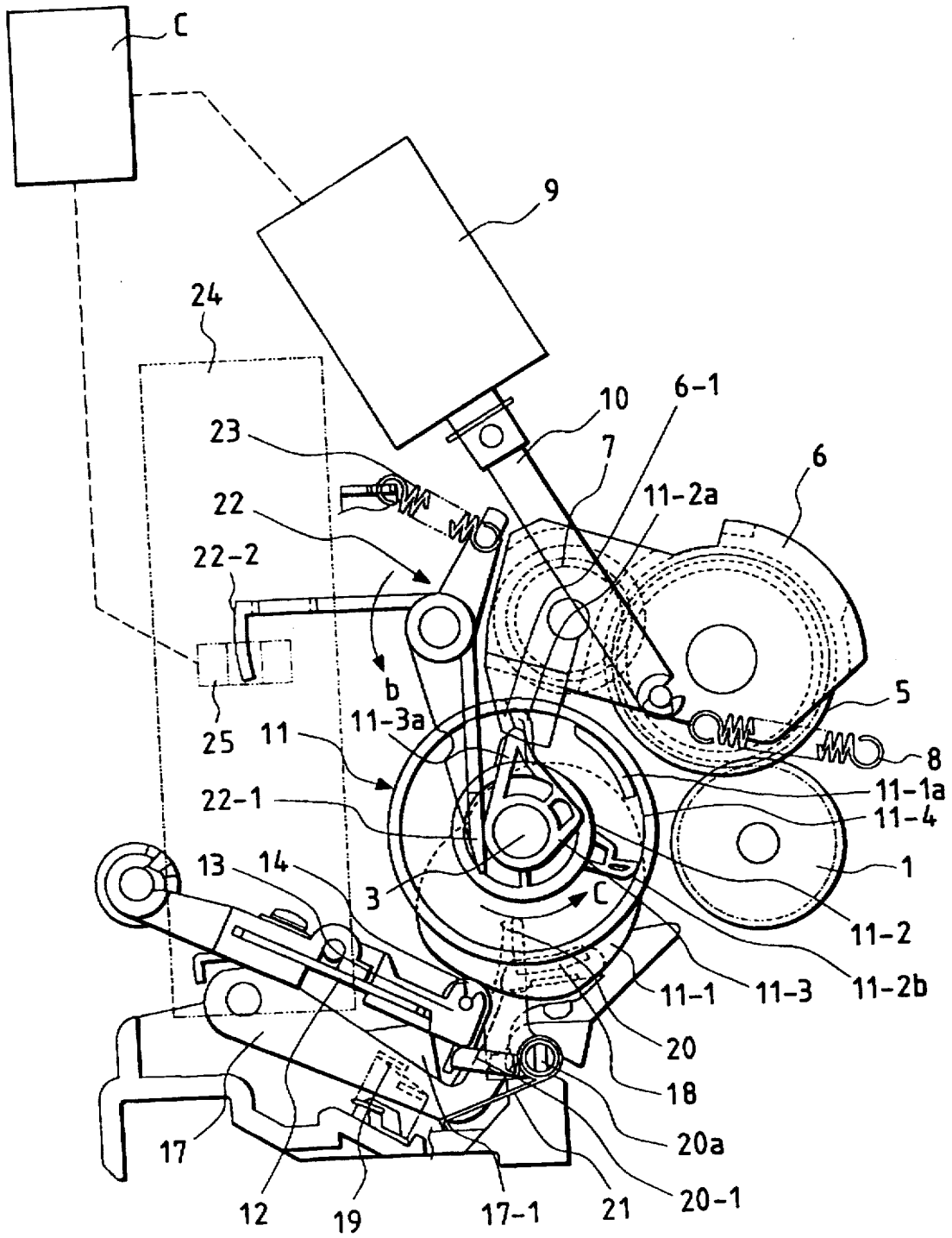
FIG. 2 is a side view of the sheet supply apparatus of FIG. 1.

In FIGS. 1 and 2, the sheet supply apparatus includes an idler gear 1 connected to a drive source (not shown) and adapted to transmit a driving force of the drive source to a sheet supplying portion, an electromagnetic clutch 2 to which the driving force is transmitted from the idler gear 1, a sheet supply shaft 3 to which the driving force is transmitted when the electromagnetic clutch 2 is energized, and a sheet supply roller 4 attached to the sheet supply shaft 3. With this arrangement, when the electromagnetic clutch 2 is energized, the driving force is transmitted from the idler gear 1 to the sheet supply shaft 3 via the electromagnetic clutch 2, thereby rotating the sheet supply roller 4.

The sheet supply apparatus further includes a stepped gear 5 which is meshed with the idler gear 1 and to which the driving force is transmitted, a rocking arm 6 disposed in coaxial with the stepped gear 5 and for supporting a rock gear 7 meshed with the stepped gear 5, a rock spring 8 for biasing the rocking arm 6 downwardly, and a solenoid 9 for pulling the rocking arm 6 upwardly via a solenoid link 10. With this arrangement, when the solenoid 9 is attracted or retracted, the rocking arm 6 is rocked upwardly in opposition to a biasing force of the rock spring 8. Incidentally, the electromagnetic clutch 2 and the solenoid 9 are controlled by a control device C.

Further, there is provided a cam gear 11 rotatably mounted on the sheet supply shaft 3. The cam gear 11 has a first cam 11-1 contacted with a roller 14 held by a roller holder 13 of a sheet support plate 12, thereby urging the sheet support plate 12 downwardly. Incidentally, a detailed construction of the cam gear 11 will be described later. The sheet support plate 12 is pivotally supported by a frame (not shown) of the sheet supply apparatus via right and left arm members 15, 16 and is biased upwardly by a pressure spring **12*a*. The sheet support plate roller holder 13 is mounted for upward rocking movement with respect to the sheet support plate 12 so that, when the roller 14 is urged downwardly by a push-down portion of the first cam 11-1, the sheet support plate 12 is lowered via the roller holder 13, but, when the roller 14 is not opposed to the push-down portion of the first cam 11-1, the roller 14 can be slidably contacted with the first cam 11-1 regardless of a position of the sheet support plate 12. A separation pad 18 formed from a high friction member is attached to a main pad arm 17 pivotally mounted on the frame of the sheet supply apparatus. The main pad arm 17 is biased upwardly by a main pad spring 19 and has projections 17-1 which can be urged against a back surface of the sheet support plate 12 when the sheet support plate 12** is lowered.

Double-feed preventing pawls 20 are secured to a support shaft **20*a* rotatably supported by the frame of the sheet supply apparatus, and the support shaft 20*a* is provided at its one end with a lever portion 20-1 contacted with a lower end of the roller holder 13. Further, the support shaft 20*a* is biased by a pawl spring 21 so that the double-feed preventing pawls 20 are rotated in a direction shown by the arrow a in FIG. 1 to retard from a double-feed preventing position. A function of the double-feed preventing pawls 20** will be described later.

A biasing arm 22 is pivotally supported by the frame (not shown) and is biased by a biasing spring 23 toward a direction shown by the arrow b in FIG. 2 to be urged against a third cam 11-3 of the cam gear 11. The biasing arm 22 serves to regulate rotation of the cam gear 11 by abutting against a predetermined position of the third cam 11-3.

Now, the construction of the cam gear 11 will be explained with reference to FIG. 3. The cam gear 11 has integrally formed first, second and third cams 11-1, 11-2, 11-3 and gear 11-4.

The first cam 11-1 is so shaped that it is contacted with the roller 14 of the sheet support plate 12 to be able to urge the latter downwardly. Accordingly, when the first cam 11-1 is rotated by one revolution, the sheet support plate 12 is lowered and lifted.

The second cam 11-2 is slidably contacted with a protruded stopper portion 6-1 formed on an end of the rocking arm 6 so that, when first and second latch portions **11-2*a*, 11-2*b* are engaged by the stopper portion 6-1, respectively, the rotation of the cam gear 11 is stopped at those positions. Incidentally, when looked along a clockwise direction, a length from the first latch portion 11-2*a* toward the second latch portion 11-2*b* is set to be shorter than a length from the second latch portion 11-2*b* toward the first latch portion 11-2*a*. The reason is that, when the stopper portion 6-1 of the rocking arm 6 is disengaged from the first latch portion 11-2*a* and engaged by the second latch portion 11-2*b*, although the sheet support plate 12 is lifted (described later), by shortening the length between the latch portions, the lifting speed of the sheet support plate 12 can be increased, and, when the stopper portion 6-1 of the rocking arm 6 is disengaged from the second latch portion 11-2*b* and engaged by the first latch portion 11-2*a*, although the sheet support plate 12 is lowered, by lengthening the length between the latch portions, the lowering speed of the sheet support plate 12 can be decreased, whereby the lifting and lowering speeds of the sheet support plate 12** can be set at the optimum.

The third cam 11-3 is slidably contacted with the biasing arm 22 so that the rotation of the cam gear 11 can be regulated by the biasing arm 22. The gear 11-4 is engaged by the rock gear 7 when the rocking arm 6 is rocked downwardly, with the result that the driving force of the idler gear 1 is transmitted to the gear via the stepped gear 5.

Incidentally, the biasing arm 22 has a flag portion 22-2 which can block light in a photo-interrupter 25 disposed on a substrate 24 in accordance with a rocked position of the biasing arm 22. Further, the third cam 11-3 is provided with a protruded portion **11-3*a* capable of being contacted with an arm portion 22-1 of the biasing arm 22 to rock the biasing arm 22, so that, when the sheet support plate 12 is in the lifted position, the biasing arm 22 is rotated by the protruded portion 11-3*a* to release the flag portion 22-2 from the photo-interrupter 25. With this arrangement, the lifted and lowered positions of the sheet support plate 12** can be discriminated.

Figure 3:
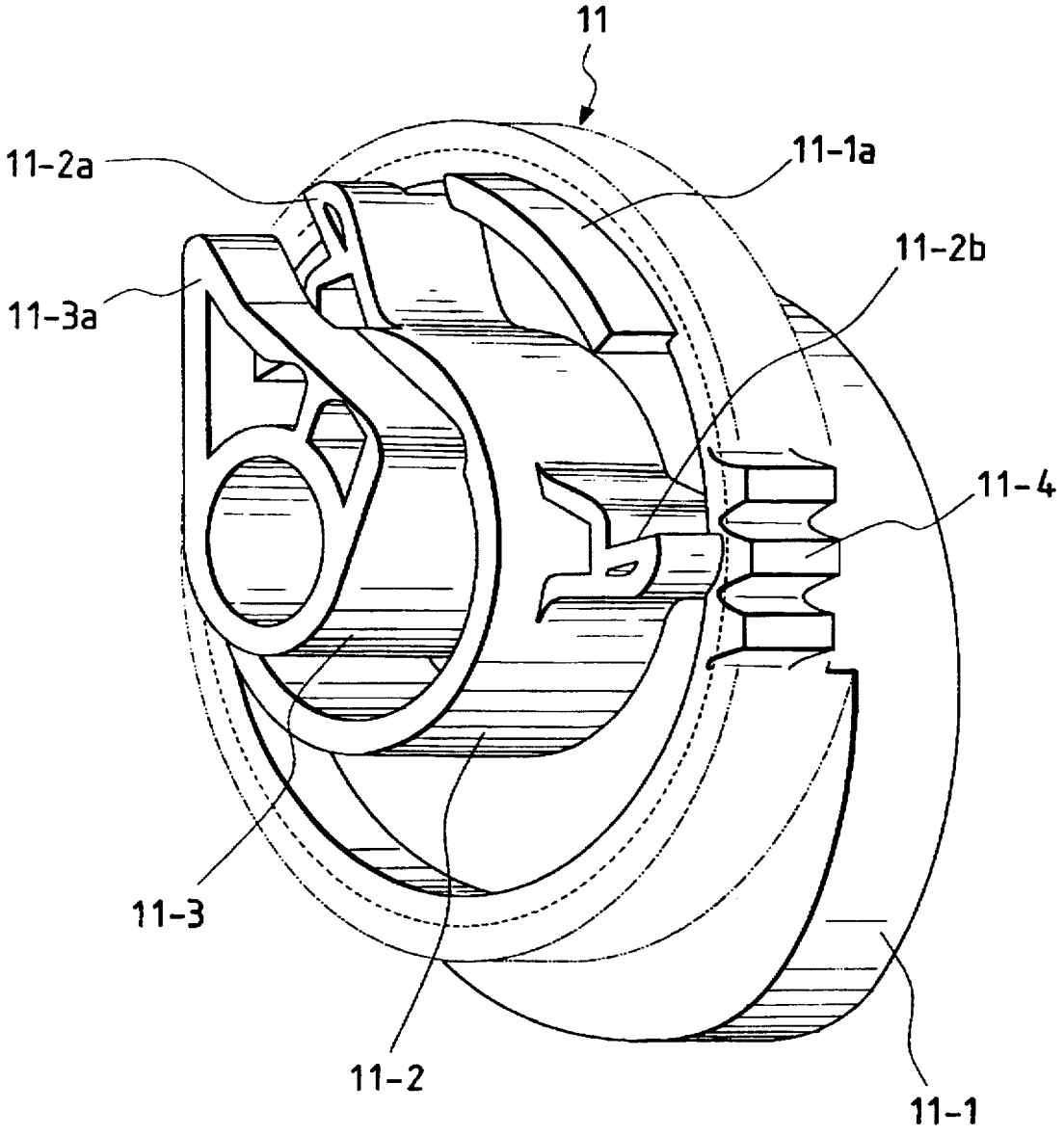
FIG. 3 is a perspective view of a cam gear of tile sheet supply apparatus of FIG. 1.

As shown in FIG. 3, the first cam 11-1 of the cam gear 11 is provided at its side surface with a rib **11-1*a* protruding toward the second cam, which rib can be engaged by the stopper portion 6-1 of the rocking arm 6. When the driving force of the idler gear 1 is transmitted to the stepped gear 6 of the rocking arm 6, moment directing toward a clockwise direction (FIG. 3) acts on the rocking arm 6 to rotate the rocking arm 6 greatly, thus causing the possibility that the stopper portion 6-1 cannot be engaged by the latch portion 11-2*a* or 11-2*b***. The provision of the rib avoids such possibility.

Incidentally, the solenoid 9 and the electromagnetic clutch 2 are appropriately controlled by the control means C (see FIG. 2) on the basis of various detection signals from the photo-interrupter 25 and the like.

Next, the operation will be explained.

First of all, in an initializing operation, when the idler gear 1 is rotated by a predetermined number of revolutions, in any position of the cam gear 11, the stopper portion 6-1 of the rocking arm 6 is engaged by either one of the latch portions **11-2*a*, 11-2*b* and is stopped there. In this case, if the photo-interrupter 2 is blocked by the flag 22-2 of the biasing arm 22, since tile sheet support plate 12 is positioned at the lowered position, the sheet supplying operation is permitted. On the other hand, if the photo-interrupter 25 is not blocked by the flag 22-2 of the biasing arm 22, since it is judged that the stopper portion 6-1 is engaged by the second latch portion 11-2*b*, by retracting the solenoid 9, the stopper portion 6-1 is disengaged from the second latch portion 11-2*b*. Consequently, the cam gear 11 is rotated to engage the first latch portion 11-2*a* by the stopper portion 6-1, thereby stopping the cam gear. In this case, if the photo-interrupter 25 is blocked by the flag 22-2 of the biasing arm 22, since the sheet support plate 12 is positioned at the lowered position, the sheet supplying operation is permitted. On the other hand, if the photo-interrupter 25 is not blocked by the flag 22-2 of the biasing arm 22**, it is judged that abnormality occurs. In this case, the operation of the apparatus is stopped, and the abnormality is displayed or alarmed.

After the initializing operation is completed, in a condition before the sheet supplying operation is started, as shown in FIGS. 1 and 2, the sheet support plate 12 is lowered by the first cam 11-1 of the cam gear 11 via the roller 14. In this case, since the rocking arm 6 is lifted by the second cam 11-2 of the cam gear 11 so that the rocking gear 7 is not engaged by the gear 11-4 of the cam gear 11, the driving force is not transmitted. Further, although the force of the pressure spring **12*a* for biasing the sheet support plate 12 upwardly acts on the first cam 11-1 via the roller 14 to bias the first cam in a direction shown by the arrow c in FIG. 2, since the stopper portion 6-1 of the rocking arm 6 is engaged by the first latch portion 11-2*a* of the second cam 11-2**, the rotation of the first cam is regulated in opposition to the biasing force of the pressure spring.

Further, the main pad arm 17 is pushed downwardly by the back surface of the lowered sheet support plate 12, and the separation pad 18 is separated from the sheet supply roller 4 not to generate the separation pressure. The lever portions 20-1 of the double-feed preventing pawls 20 are pushed by the lowered sheet support plate 12, so that the pawls are shifted in a double-feed preventing position in opposition to the biasing force of the pawl spring 21.

Figure 5:
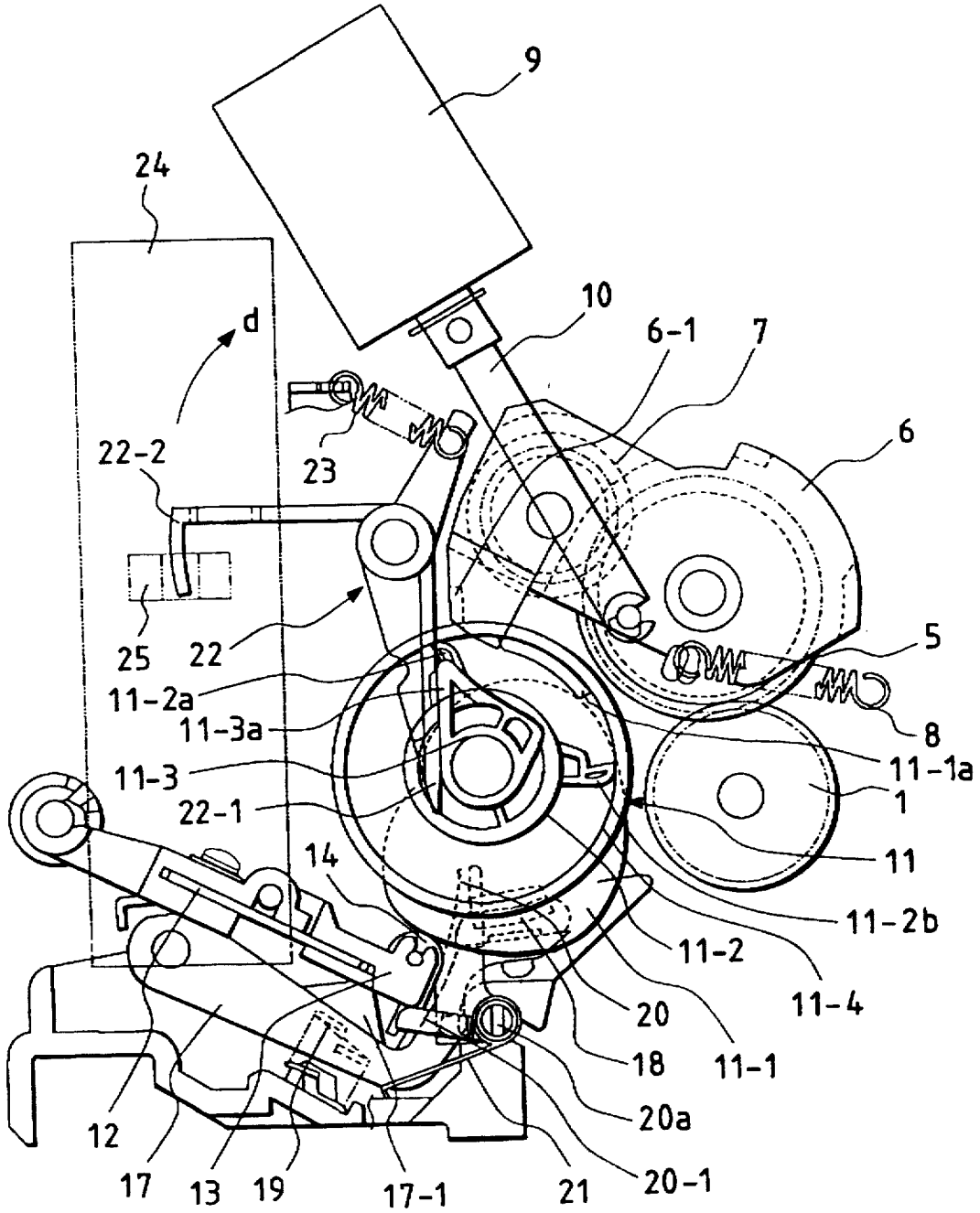
FIGS. 5 to 10 are views showing an operation of the sheet supply apparatus of FIG. 1.

Then, when the solenoid 9 is retracted to start the sheet supplying operation, the rocking arm 6 is lifted via the solenoid link 10. As a result, since the stopper portion 6-1 of the rocking arm 6 is disengaged from the first latch portion **11-2*a* of the second cam 11-2 of the cam gear 11, the cam gear 11 starts to be rotated by a force which acts on the first cam 11-1 from the roller 14. Consequently, as shown in FIG. 5, the third cam 11-3 of the cam gear 11 abuts against the arm portion 22-1 of the biasing arm 22 biased by the biasing spring 23 and is stopped there. The biasing force of the biasing spring 23 is selected to be greater than the force -which acts on the first cam 11-1 from the roller 14 to rotate the cam gear 11**.

The reason why the cam gear 11 is temporarily stopped by the rocking arm 6 in this way is that the cam gear 11 is prevented from being rotated abruptly and excessively by the force from the roller 14. For example, if the rotation of the cam gear 11 is too fast, the latch portion will pass through the stopper portion 6-1 before the solenoid 9 is disenergized to lower the rocking arm 6 so that the stopper portion can catch the latch portion. As a result, the sheet support plate 12 is lowered again, thereby causing the poor sheet supply. To the contrary, when the call gear 11 is temporarily stopped as mentioned above, by rotating the cam gear 11 by the rotation of the rocking arm 6 in a manner which will be described hereinbelow, such poor sheet supply can be prevented.

Figure 6:
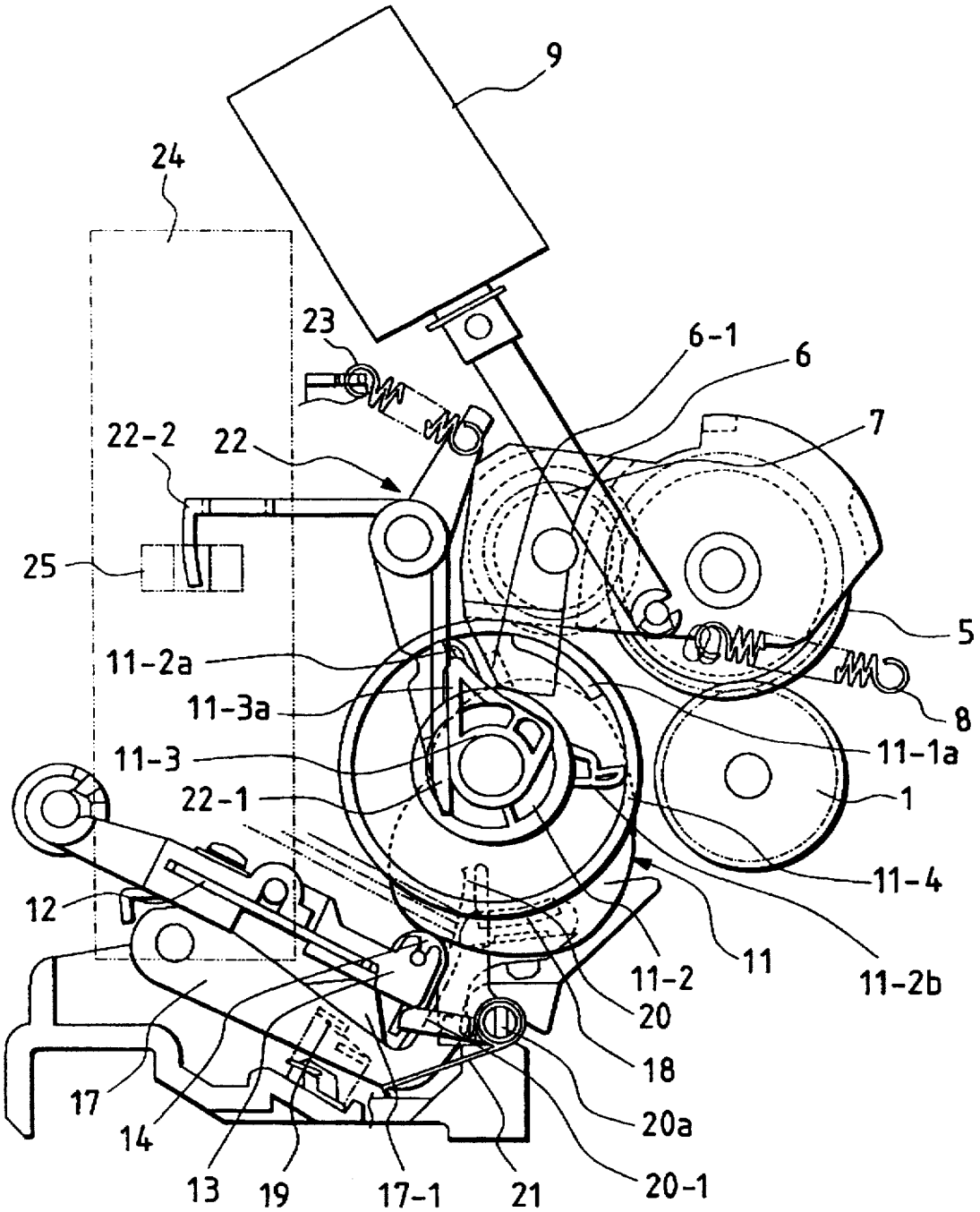

In this condition, the solenoid 9 is disenergized as shown in FIG. 6, the sheet support plate 12 is lowered to engage the rock gear 7 by the gear of the cam gear 11, thereby starting the rotation of the cam gear 11. When the cam gear 11 is rotated, the sheet support plate 12 which was lowered by the first cam 11-1 is lifted by the biasing force of the pressure spring 12*a*. When the sheet support plate 12 is lifted, the main pad arm 17 is rotated by the main pad spring 19 to urge the separation pad 18 against the sheet supply roller 4, and, the double-feed preventing pawls 20 are rotated in the direction a (FIG. 1) toward a waiting position by the pawl spring 21 since the regulation of the lever portions 20-1 is released due to the rotation of the sheet support plate 12.

Further, as the cam gear 11 further rotated, the arm portion 22-1 of the biasing arm 22 is pushed by the projection 11-3*a* of the third cam 11-3 of the cam gear 11. As a result, the biasing arm 22 is rotated to rotate the flag portion 22-2 in a direction shown by the arrow d, thereby disengaging the flag from the photo-interrupter 25. When the cam gear 11 is rotated up to a position shown in FIG. 7, the rocking arm 6 is lifted by the second cam 11-2 of the cam gear 11 to disengage the rock gear 7 from the gear 11-4 of the cam gear 11, thereby prohibiting the transmission of the driving force.

Figure 7:
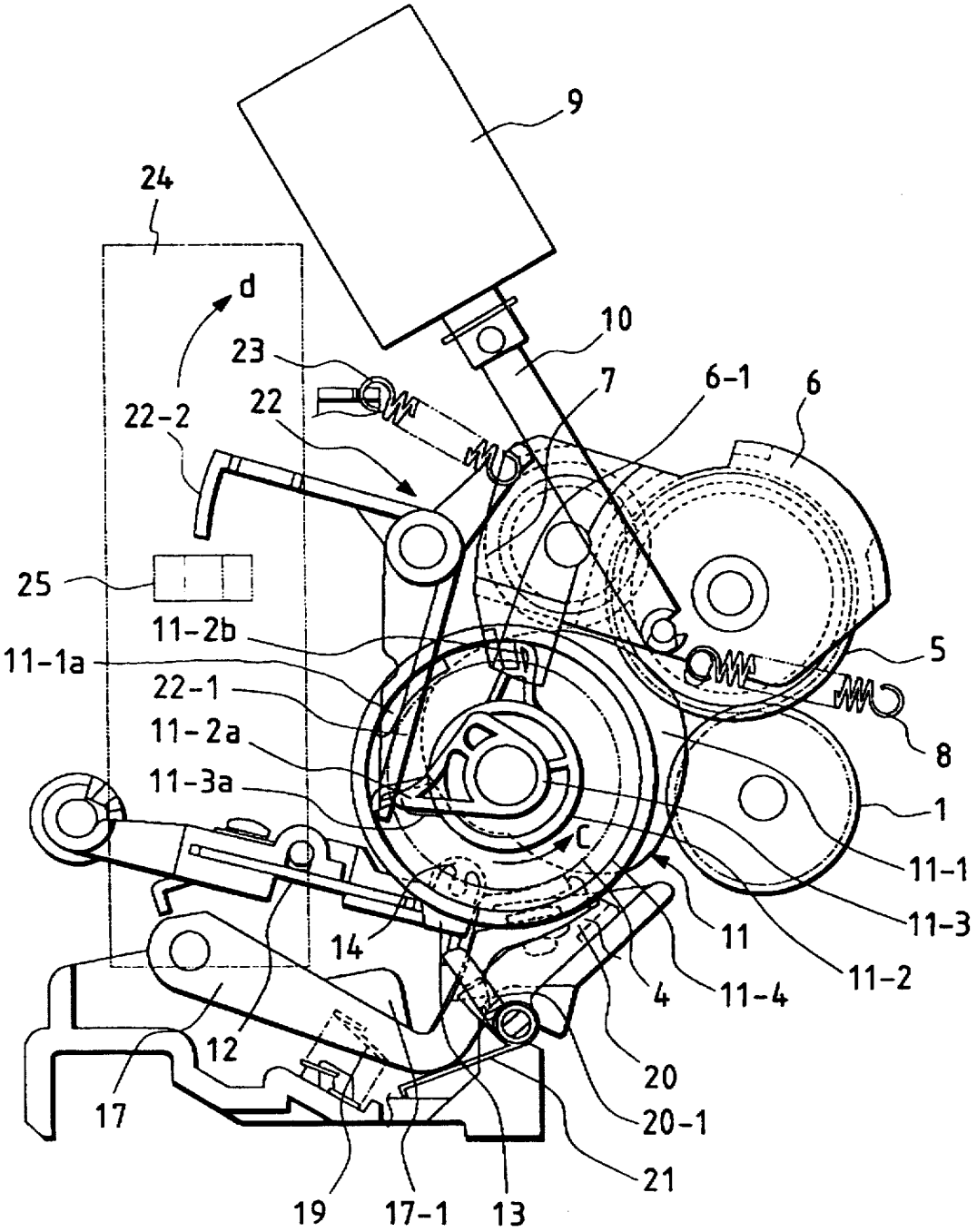
Figure 8:
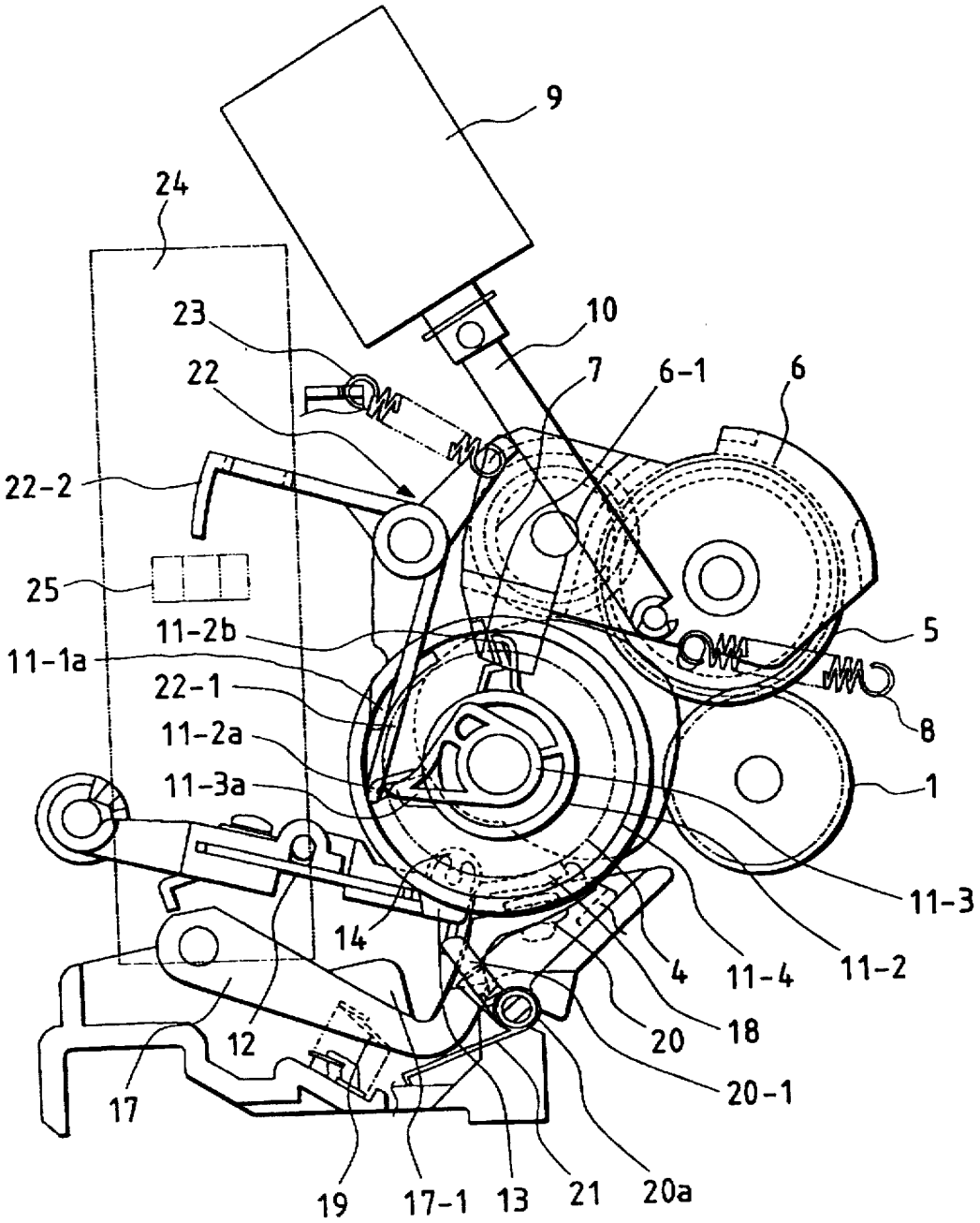

In the condition shown in FIG. 7, since the third cam 11-3 of the cam gear 11 is rotatingly biased toward the direction c by the arm portion 22-1 of the biasing arm 22, the cam gear 11 is rotated up to a condition shown in FIG. 8. In this condition, the stopper portion 6-1 of the rocking arm 6 abuts against the second latch portion 11-2*b* of the second cam 11-2 of the cam gear 11, thereby stopping the cam gear.

When the cam gear 11 is rotated up to this condition, since the projection of the main pad arm 17 is separated from the sheet support plate 12, the main pad arm 17 is completely lifted to urge the separation pad 18 against the sheet supply roller 4, thereby generating the predetermined separating pressure. Further, since the double-feed preventing pawls 20 are completely retarded, the sheet supplying operation can be started.

Then, when the electromagnetic clutch 2 is energized, the sheet supply roller 4 is rotated to feed out the sheet(s) from the sheet support plate 12, and the fed sheets are separated one by one between the sheet supply roller and the separation pad 18. The energization of the electromagnetic clutch 2 is effected at a time when a predetermined time period is elapsed after the solenoid 9 was disenergized (but, after the sheet support plate 12 was lifted).

The separated sheet is sent, by the sheet supply roller 4, to a pair of regist rollers 26 (FIG. 4) disposed at a downstream side of the sheet supply roller. In this case, the sheet supply roller 4 continues to feed the sheet until a loop is formed in the sheet between the regist rollers 26 and the sheet supply roller 4. By forming the loop in the sheet, the skew-feed of the sheet is corrected, and then, the sheet is sent to an image forming means in synchronous with image formation. When the loop is formed in the sheet, the electromagnetic clutch 2 is disenergized to stop the rotation of the sheet supply roller 4.

The regist rollers 26 are rotated in a timed relation to the image forming means to send the sheet. In this case, the electromagnetic clutch 2 is energized again to rotate the sheet supply roller 4 by a predetermined time period so that, by sending the sheet while forming the loop in the sheet, back tension acting on the sheet can be minimized.

Figure 9:
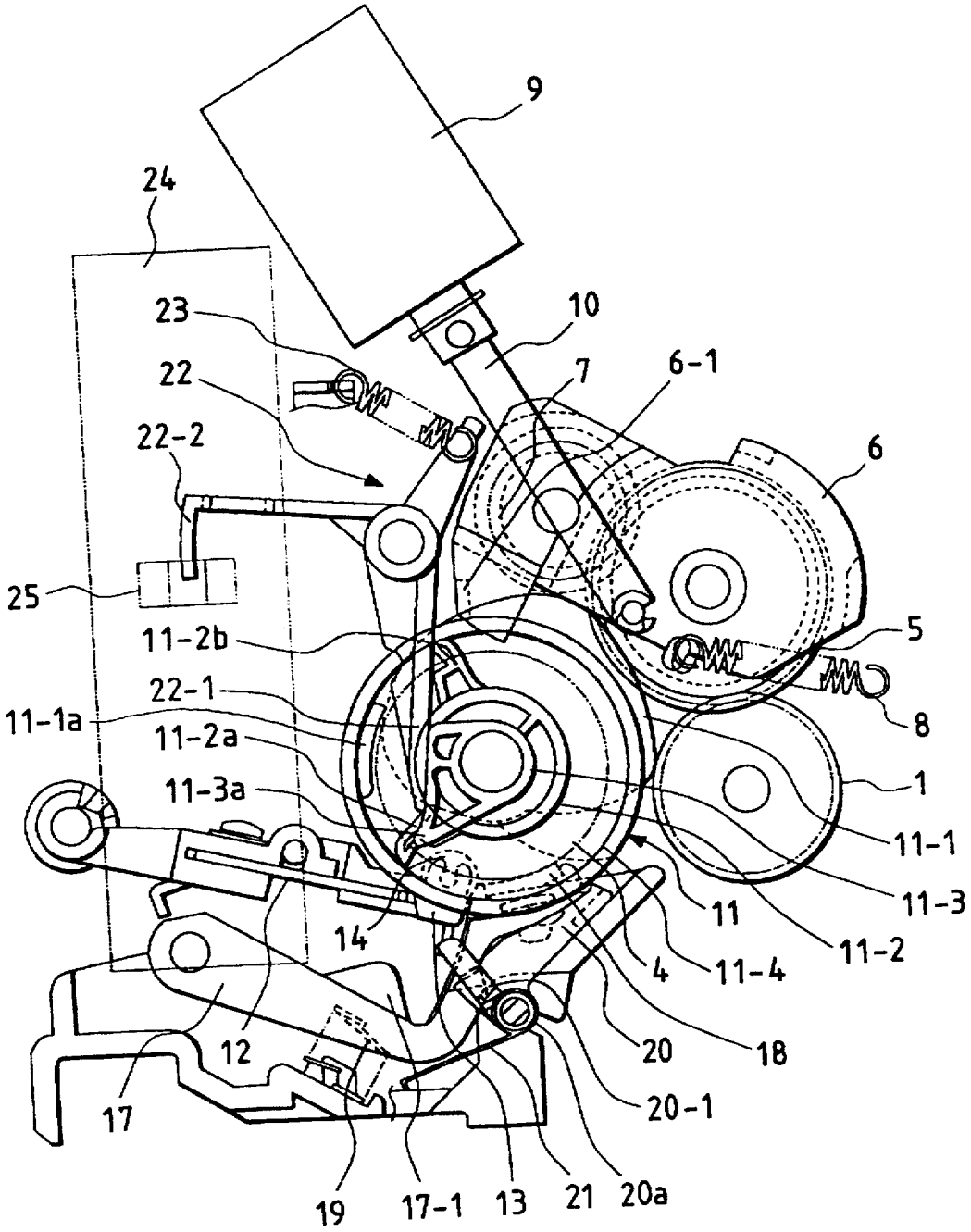

At the same time of the re-energization of the electromagnetic clutch 2, the solenoid 9 is retracted, thereby lifting the rocking arm 6 via the solenoid link 10. Due to the rotation of the rocking arm 6, since the stopper portion 6-1 is disengaged from the second latch portion 11-2*b*, as shown in FIG. 8, the cam gear 11 biased by the arm portion 22-1 of the biasing arm 22 starts to rotate. As shown in FIG. 9, the rotation of the cam gear 11 is regulated by the arm portion 22-1 of the biasing arm 22 to stop the cam gear. The reason why the cam gear 11 is temporarily stopped in this way is the same reason as the temporary stop of the cam gear when the sheet support plate is lifted, thereby preventing the cam gear 11 from being rotated abruptly and excessively. When the solenoid 9 is disenergized, the rocking arm 6 is lowered to engage the rock gear 7 by the gear 11-4 of the cam gear 11, thereby permitting the transmission of the driving force.

Figure 10:
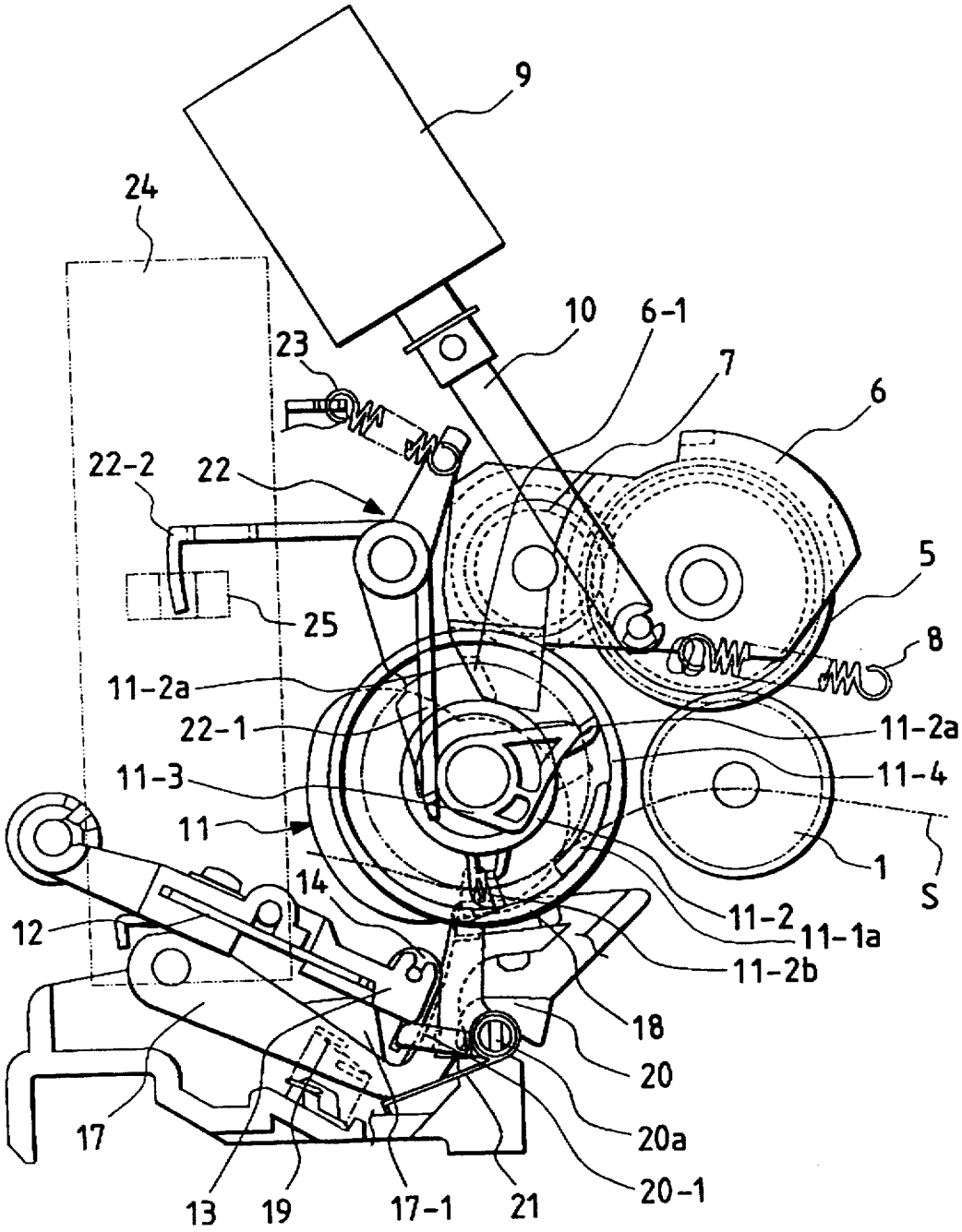

When the cam gear 11 is rotated, as shown in FIG. 10, the sheet support plate 12 is lowered by the first cam 11-1 of the cam gear 11 via the roller 14. When the sheet support plate 12 is lowered, the main pad arm 17 is lowered by the back surface of the sheet support plate 12 to separate the separation pad 18 from the sheet supply roller 4, thereby releasing the separation pressure. As a result, the back tension is preventing from acting on the fed sheet.

Further, since the lever portion 20-1 is pushed downwardly by the roller holder 13 of the sheet support plate, the double-feed preventing pawls 20 are rotated to the double-feed preventing position and are cocked at that position. At this point, since the sheet S does not leave the sheet supply roller 4 and is in the condition shown in FIG. 10, the double-feed preventing pawls 20 are shifted while slidingly contacting with the back surface of the sheet S which is being fed, thereby regulating the movement of the second and other sheets double-fed together with the first sheet after the separating pressure of the separation pad 18 is released. Further, the double-feed preventing pawls 20 are rotated from the downstream side to the upstream side, the second and other sheets are returned onto the sheet support plate 12. As a result, since the tip ends of the sheets are aligned with each other at the stacked position on the sheet support plate 12, in the next sheet supplying operation, the poor separation due to misalignment between the tip ends of the sheets and the poor sheet supply due to the improper sheet supplying timing can be prevented.

Then, as the cam gear 11 is further rotated and is returned to a position near the sheet supply start position, the rocking arm 6 is lifted again by the first latch portion 11-2*a* of the second cam 11-2 to disengage the rock gear 7 from the gear of the cam gear 11, thereby interrupting the transmission of the driving force. The cam gear 11 is rotated by the force from the roller 14, and, when the stopper portion 6-1 of the rocking arm 6 is engaged by the first latch portion 11-2*a* of the second cam 11-2 of the cam gear 11 again as shown in FIG. 2, the rotation of the cam gear is regulated. As a result, the initial condition is restored.

The above-mentioned is the operation for supplying a single sheet. When the sheets are continuously supplied, the above-mentioned operation is repeated.

Next, a mechanism for positively driving the double-feed preventing pawls 20 will be explained. If an amount of sheets stacked on the sheet support plate is great, since the shifting amount of the sheet support plate is small, the double-feed preventing pawls 20 cannot be shifted enough to achieve the prevention of the double-feed. This mechanism serves to achieve the prevention of the double-feed even in such a case.

To this end, the sheet support plate roller holder 13 is pivotally mounted on the sheet support plate 12 in such a manner that the roller holder 13 can be rotated upwardly from the sheet supporting surface of the sheet support plate but cannot be rotated below the sheet supporting surface. The detailed construction will be further described.

Figure 11:
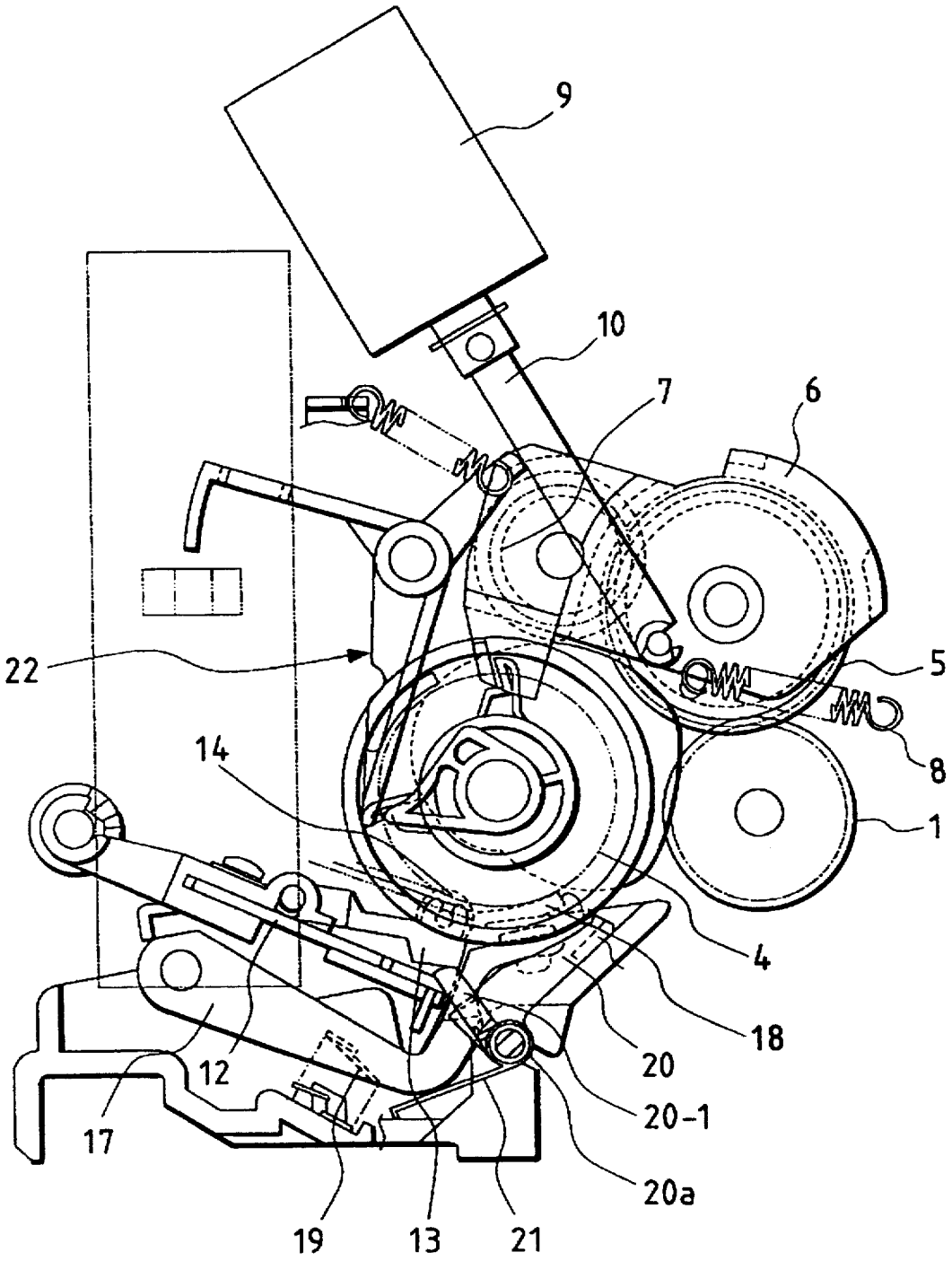
FIG. 11 is a view showing a condition that there are many sheets stacked on a sheet support plate in the sheet supply apparatus of FIG. 1.

As shown in FIG. 11, in the case where the amount of sheets stacked an the sheet support plate 12 is great, when the cam gear 11 is rotated to a position to which the sheet support plate 12 can be lifted, since the sheet stack on the sheet support plate abuts against the sheet supply roller 4 to limit the lifting movement of the sheet support plate 12, the sheet support plate 12 itself is scarcely lifted. However, since the roller holder 13 is pivotally mounted on the sheet support plate 12, the roller holder 13 and the roller 14 can be rocked regardless of the position of the sheet support plate 12. Accordingly, it is permitted that the lever portion 20-1 of the double-feed preventing pawls 20 is rotated by the pawl spring 21, and, thus, the adequate shifting amount of the double-feed preventing pawls 20 can be ensured. With this arrangement, the double-feed preventing pawls 20 can be positively driven regardless of the amount of sheets stacked on the sheet support plate 12.

Figure 12:
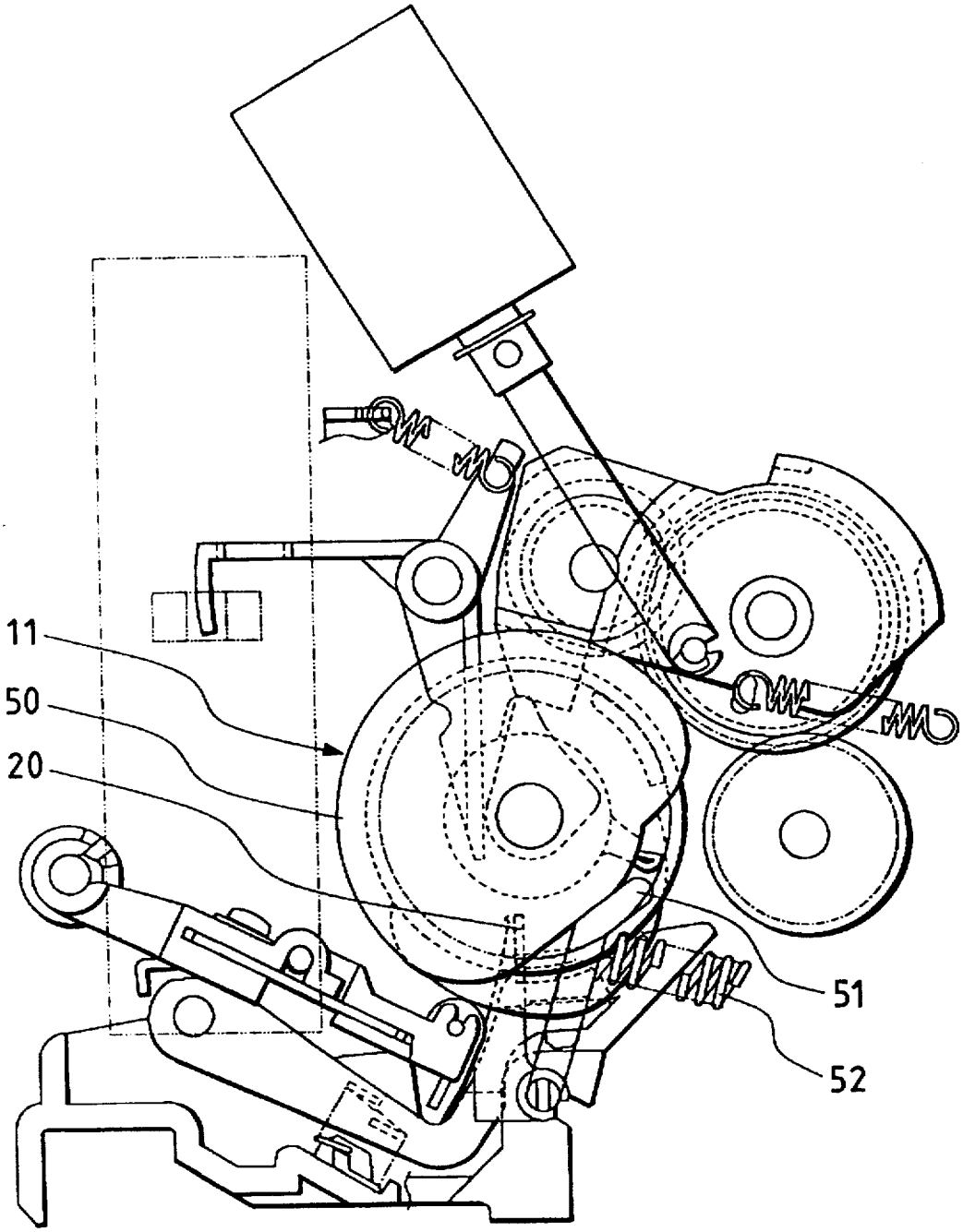
FIG. 12 is a side view of a sheet supply apparatus according to a second embodiment of the present invention.
Figure 13:
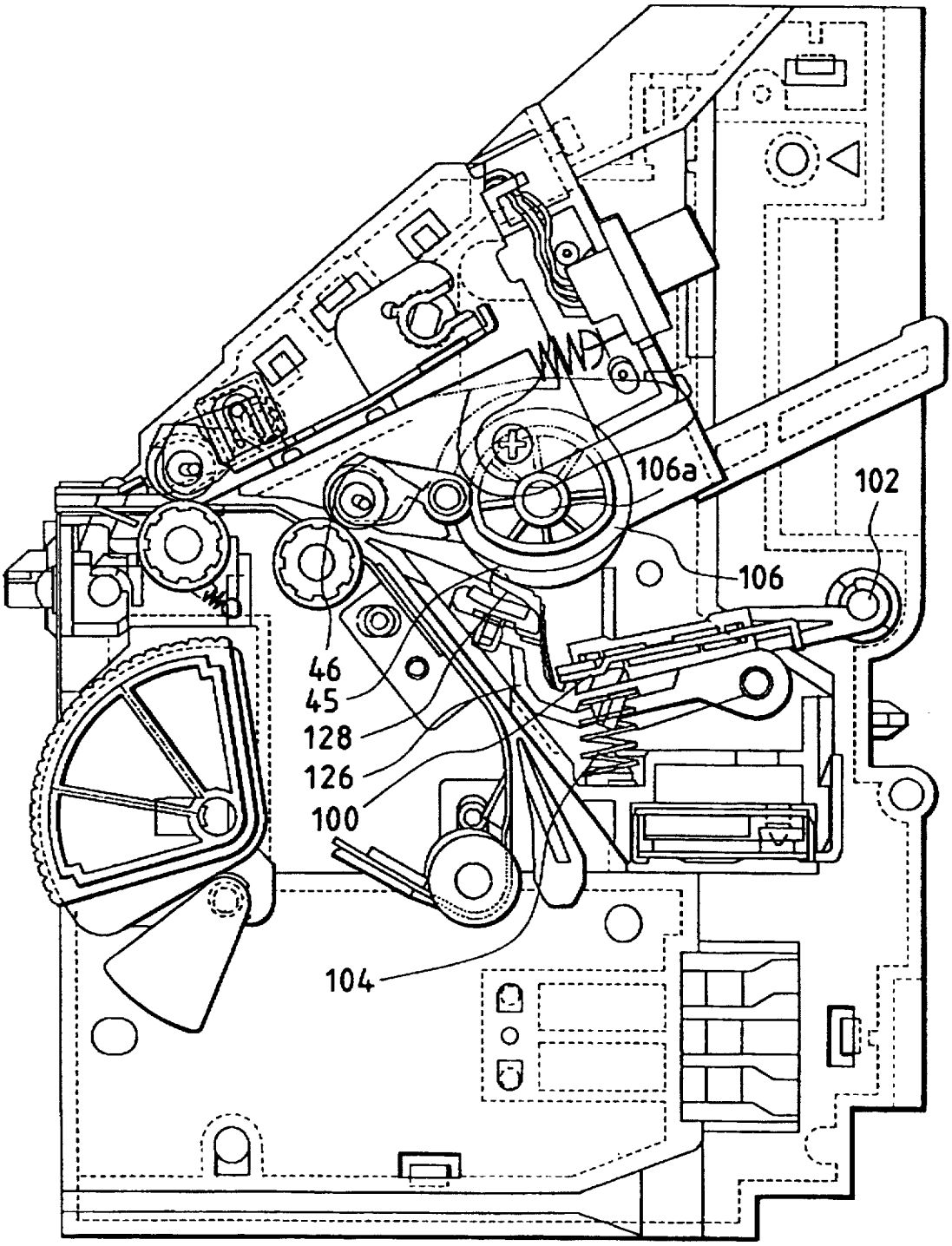
FIG. 13 PRIOR ART
FIG. 13 is a sectional view of a conventional sheet supply apparatus.
Figure 14:
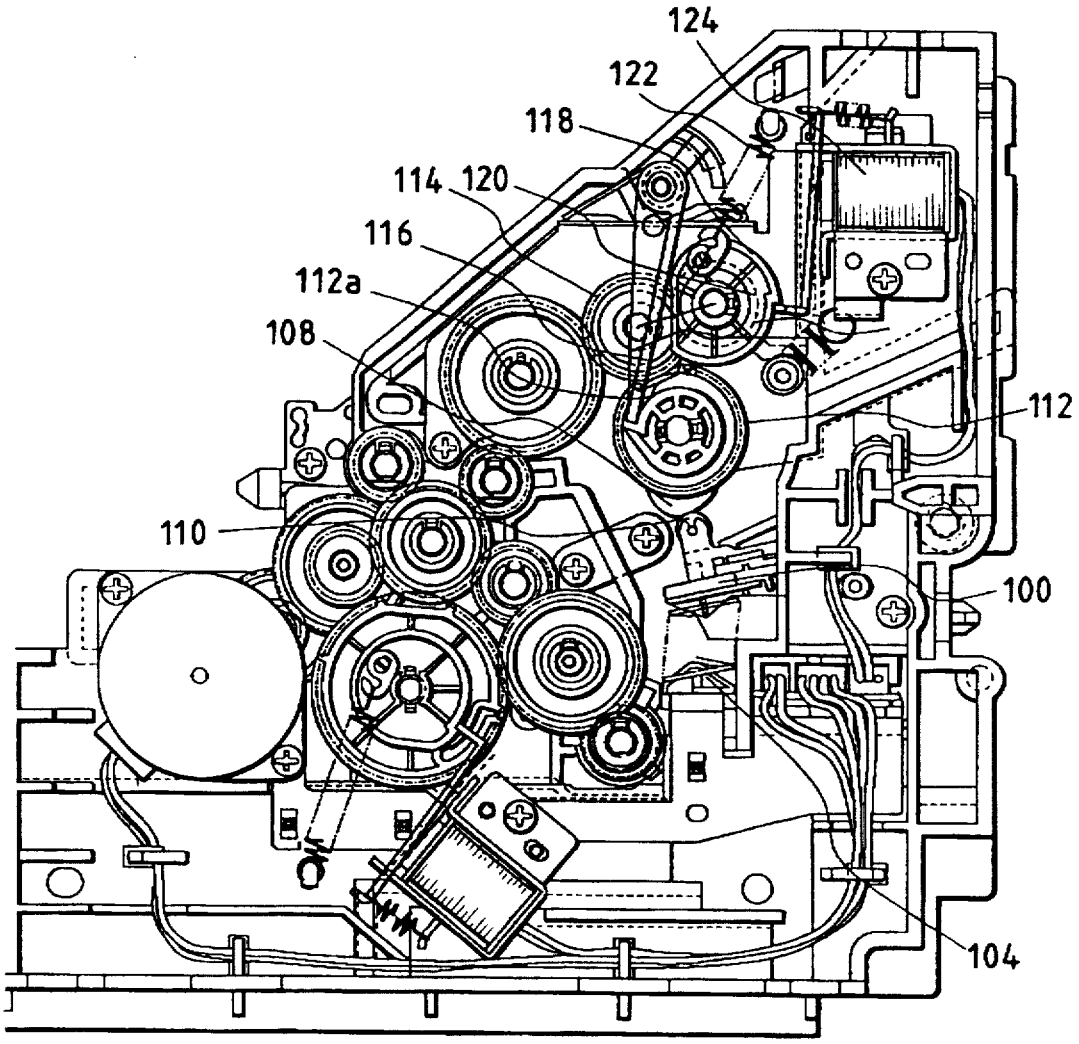
FIG. 14 PRIOR ART
FIG. 14 is a sectional view showing a drive system of the sheet supply apparatus of FIG. 13.

Next, a second embodiment of the present invention will be explained with reference to FIG. 12. In this embodiment, an exclusive cam 50 for exclusively rocking the double-feed preventing pawls 20 is provided on the sheet supply shaft 3. Since the other constructions and functions are the same as those in the first embodiments, detailed explanation thereof will be omitted.

A support shaft 20*a* on which double-feed preventing pawls 20 are secured is rotatably supported by the frame of the sheet supply apparatus, and a cam follower 51 is secured to one end of the support shaft 20*a*. The cam follower 51 is slidably contacted with the exclusive cam 50 by means of a spring 52. In this arrangement, in response to the rotation of the sheet supply shaft 3, the exclusive cam 50 is rotated to rock the double-feed preventing pawls 20.

Incidentally, when the double-feed preventing pawls 20 are rocked by using the exclusive cam 50 in this way, since the double-feed preventing pawls 20 can be rocked regardless of the lifting/lowering timing of the sheet support plate 12, the rocking timing of the double-feed preventing pawls 20 can be selected within a wider ranged.

Next, an example of an image forming apparatus having the above-mentioned sheet supply apparatus A will be explained with reference to FIG. 4.

Figure 4:
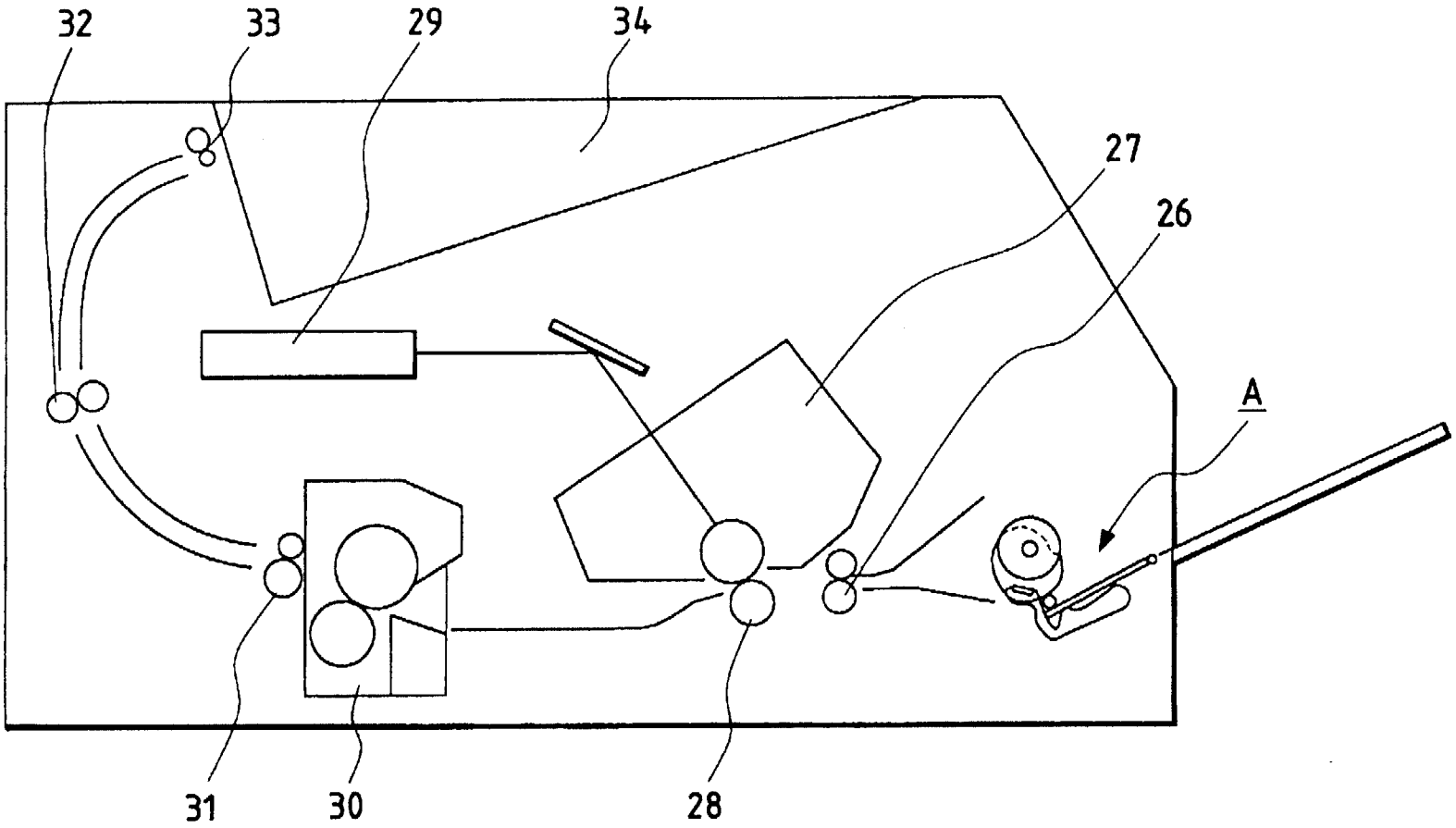
FIG. 4 is a schematic sectional view of an image forming apparatus having a sheet supply apparatus according to the present invention.

In FIG. 4, a pair of regist rollers 26 are disposed at a downstream side of the sheet supply apparatus A. The regist rollers 26 serve to feed out the sheet in synchronous with the timing of an image forming means. The image forming means includes a means (such as a drum cartridge 27, a transfer roller 28 and the like) for transferring an image on the sheet, a scanner unit 29 for illuminating laser light onto a drum in the drum cartridge 27, and a fixing unit 30 for fixing the image (transferred to the sheet) to the sheet.

The sheet on which the image was formed by the image forming means is conveyed by pairs of convey rollers 32, 32 and is discharged onto a discharge tray 34 by means of a pair of discharge rollers 33.

As mentioned, above, according to the present invention, since the rotation of the sheet supply means is controlled by the rotation control means and the lifting/lowering movement of the sheet support plate is effected by the rotation of the cam in response to the rocking movement of the rock gear, and the rotation of the sheet supply means and the lifting/lowering movement of the sheet support plate are controlled independently, the sheet feeding amount of the sheet supply means can be set freely and appropriately. Thus, the distance between the sheet supply means and the downstream convey rollers can be set freely, thereby avoiding the cost-up and preventing the apparatus from being made bulky. Further, a degree of freedom for design is increased.

Further, according to the present invention, since the rotation of the cam is regulated by the stopper means at the position where the sheet support plate is lifted, and the sheet supply means is rotated by the rotation control means, the sheet feeding amount can be set freely. And, by temporarily regulating the rotation of the cam by means of the rotation regulating means when the regulation of the stopper means is released, since the excessive rotation of the cam effected by the biasing means can be prevented to avoid the poor operation, the reliability of the apparatus can be enhanced.

It should be noted that the present invention is not limited to the above-mentioned embodiment.

What is claimed is:

1. A sheet supply apparatus comprising:

a rocking sheet support plate for stacking sheets thereon;

sheet supply means capable of contacting with the sheets stacked on said sheet support plate for supplying them;

rotation control means for controlling rotation of said sheet supply means, by transmitting or interrupting a driving force from a drive source;

first cam means for rocking said sheet support plate so that the sheet thereon is abutted against or separated away from said sheet supply means; and a rock gear engaged with or disengaged from a cam gear connected to said first cam means for transmitting or interrupting a rotation motion from the drive source to said first cam means;

second cam means connected to said first cam means for rocking said rock gear;

wherein the rotation motion from the drive source is transmitted or interrupted to said first cam means when said rock gear engages with or disengages from said cam gear in accordance with a rocking movement of said rock gear.

2. A sheet supply apparatus according to claim 1, wherein said rotation control means is an electromagnetic clutch.

3. A sheet supply apparatus according to claim 1, wherein said rock gear is supported by a rocking arm, and said second cam includes a latch portion for shifting said rocking arm to separate said cam gear of said first cam means from said rock gear, and for engaging said latch portion by a stopper portion provided on said rocking arm to stop the rotation of said first cam means.

4. A sheet supply apparatus according to claim 3, further comprising an actuator means for separating said stopper portion of said rocking arm from said latch portion.

5. A sheet supply apparatus according to claim 1, wherein said second cam has a first latch portion and a second latch portion so that said first latch portion stops the rotation of said first cam means when said first cam means pushes said sheet support plate downwardly to separate the sheet from said sheet supply means, and said second latch portion stops the rotation of said first cam means when said first cam means does not regulate said sheet support plate.

6. A sheet supply apparatus according to claim 5, wherein said rotation control means is controlled so that said sheet supply means is rotated to feed out the sheet when the rotation of said first cam means is stopped by said second latch portion.

7. A sheet supply apparatus comprising:

a rocking sheet support plate for stacking sheets;

sheet supply means capable of contacting with the sheets stacked on said sheet support plate for supplying them;

rotation control means for controlling rotation of said sheet supply means, by transmitting or interrupting a driving force from a drive source;

cam means for rocking said sheet support plate so that the sheet thereon is abutted against or separated away from said sheet supply means by rotation of said cam means;

rotation transmitting means for transmitting a rotation motion of said drive means to said cam means;

biasing means for biasing said cam means in a rotational direction the same as that driven by the drive force;

stopper means for regulating the rotation of said cam means by said biasing means when the rotation motion of the drive means transmitted to said cam means by said rotation transmitting means is interrupted; and rotation regulating means for temporarily stopping the rotation of said cam means in opposition to a biasing force of said biasing means when the regulation of said stopper means is released.

8. A sheet supply apparatus according to claim 7, wherein said rotation control means is an electromagnetic clutch.

9. A sheet supply apparatus according to claim 7, wherein said stopper means regulates the rotation of said cam means at a lowered and a lifted position of said sheet support plate, and said rotation regulating means temporarily stops the rotation of said cam means when the regulation of the rotation of said cam means by said stopper means at the lowered and lifted positions is released.

10. A sheet supply apparatus according to claim 9, wherein said rotation transmitting means includes a rock gear capable of being engaged by a gear connected to said cam means and connected to said drive source to receive the driving force, so that the rotation motion of said drive source to said cam means is transmitted when said rock gear is engaged by said gear of said cam means, and is interrupted when said rock gear is disengaged from said gear.

11. A sheet supply apparatus according to claim 10, wherein said stopper means comprises a pair of latch portions provided on a second cam connected to said cam means, and a stopper portion provided on a rocking arm pivotally supporting said rock gear, so that the rotation of said cam means is regulated when said stopper portion is engaged by one of said latch portions.

12. A sheet supply apparatus according to claim 11, wherein said latch portions have a function for shifting said rocking arm to separate said rock gear from said gear connected to said cam means.

13. A sheet supply apparatus according to claim 9, wherein said rotation control means is controlled so that said sheet supply means is rotated to feed out the sheet, when the rotation of said cam means is stopped at the lifted position of said sheet support plate.

14. An image forming apparatus comprising:

a rocking sheet support plate for stacking sheets thereon;

sheet supply means capable of contacting with the sheets stacked on said sheet support plate for supplying them;

rotation control means for controlling rotation of said sheet supply means, by transmitting or interrupting a driving force from a drive source;

first cam for rocking said sheet support plate so that the sheet thereon is abutted against or separated away from said sheet supply means;

a rock gear engaged with or disengaged from a cam gear connected to said first cam means for transmitting or interrupting a rotation motion from the drive source to said first cam means;

second cam means connected to said first cam means for rocking said rock gear; and an image forming means for forming an image on the sheet fed out by said sheet supply means;

wherein the rotation motion from the drive source is transmitted or interrupted to said first cam means when said rock gear engages with or disengages from said cam gear in accordance with a rocking movement of said rock gear.

15. An image forming apparatus comprising:

a rocking sheet support plate for stacking sheets;

sheet supply means capable of contacting with the sheets stacked on said sheet support plate for supplying them;

rotation control means for controlling rotation of said sheet supply means, by transmitting or interrupting a driving force from a drive source;

cam means for rocking said sheet support plate so that the sheet thereon is abutted against or separated away from said sheet supply means by rotation of said cam means;

rotation transmitting means for transmitting a rotation motion of said drive means to said cam means;

biasing means for biasing said cam means in a rotational direction the same as that driven by the drive force;

stopper mean for regulating the rotation of said cam means by said biasing means when the rotation motion of the drive means transmitted to said cam means by said rotation transmitting means is interrupted;

rotation regulating means for temporarily stopping the rotation of said cam means in opposition to a biasing force of said biasing means when the regulation of said stopper means is released; and an image forming means for forming an image on the sheet fed out by said sheet supply means.

16. A sheet supply apparatus comprising:

a sheet support plate movable between a sheet supply position and a waiting position for supporting sheets;

sheet supply means for supplying the sheet supported on said sheet support plate at the sheet supply position;

rotation control means for controlling rotation of said sheet supply means by transmitting or interrupting a driving force from a drive source;

first cam means for shifting said sheet support plate to the sheet supply position or the waiting position by rotation of said first cam means;

a rock gear engaged with or disengaged from a cam gear connected to said first cam means for transmitting or interrupting a rotation from the drive source to said first cam means; and second cam means for rocking said rock gear between an engage position where said rock gear is engaged with said cam gear and a disengaged position where said rock gear is disengaged from said cam gear;

wherein the rotation from the drive source to said first cam means is transmitted or interrupted when said rock gear engages with or disengages from said cam gear in accordance with rocking movement of said rock gear by said second cam means.

17. A sheet supply apparatus according to claim 16, wherein second cam means is rotated by receiving the rotation from said drive for rocking said rock gear.

18. A sheet supply apparatus according to claim 16, wherein said rotation control means transmits the driving force to said sheet supply means, when said first cam means shifts said sheet support plate to the supply position and said second cam means rocks said gear to the disengaged position.

19. An image forming apparatus comprising:

a sheet support plate movable between a sheet supply position and a waiting position for supporting sheets;

sheet supply means for supplying the sheet supported on said sheet support plate at the sheet supply position;

rotation control means for controlling rotation of said sheet supply means by transmitting a driving force from a drive source;

first cam means for shifting said sheet support plate to the sheet supply position or the waiting position by rotation of said first cam means;

a rock gear engaged with or disengaged from a cam gear connected to said first cam means for transmitting or interrupting a rotation from the drive source to said first cam means;

second cam means for rocking said rock gear between an engage position where said rock gear is engaged with said cam gear and a disengaged position where said rock gear is disengaged from said cam gear; and image forming means for forming an image on the sheet fed out by said sheet supply means;

wherein the rotation from the drive source to said first cam means is transmitted or interrupted when said rock gear engages with or disengages from said cam gear in accordance with rocking movement of said rock gear by said second cam means.

* * * * *